US010041216B2

(12) United States Patent
Wise et al.

(10) Patent No.: US 10,041,216 B2
(45) Date of Patent: Aug. 7, 2018

(54) MODULAR BRIDGE, A BRIDGE MODULE FOR A MODULAR BRIDGE, AND METHODS FOR ASSEMBLY

(71) Applicant: OVE ARUP & PARTNERS INTERNATIONAL LIMITED, London (GB)

(72) Inventors: Ian Wise, Bristol (GB); Roland Trim, Bristol (GB)

(73) Assignee: ARUP VENTURES LIMITED, London (GB)

( * ) Notice: Subject to any disclaimer, the term of this patent is extended or adjusted under 35 U.S.C. 154(b) by 0 days.

(21) Appl. No.: 15/301,941

(22) PCT Filed: Mar. 30, 2015

(86) PCT No.: PCT/GB2015/050967
§ 371 (c)(1),
(2) Date: Oct. 4, 2016

(87) PCT Pub. No.: WO2015/150766
PCT Pub. Date: Oct. 8, 2015

(65) Prior Publication Data

US 2017/0191232 A1 Jul. 6, 2017

(30) Foreign Application Priority Data

Apr. 4, 2014 (GB) ..... 1406153.5

(51) Int. Cl.
*E01D 2/00* (2006.01)
*E01D 15/133* (2006.01)
(Continued)

(52) U.S. Cl.
CPC ..... *E01D 15/133* (2013.01); *E01D 2/00* (2013.01); *E01D 15/005* (2013.01); *E01D 15/10* (2013.01); *E01D 21/06* (2013.01); *E01D 2101/40* (2013.01)

(58) Field of Classification Search
CPC ..... E01D 2/00; E01D 15/133; E01D 15/005; E01D 15/10; E01D 21/06
(Continued)

(56) References Cited

U.S. PATENT DOCUMENTS 4,318,361 A * 3/1982 Sluys ..... B63B 5/14 114/263
4,799,279 A * 1/1989 Muller ..... E01D 11/04 14/18
(Continued)

FOREIGN PATENT DOCUMENTS

DE 1534205 5/1969
FR 1 365 143 A 6/1964
(Continued)

OTHER PUBLICATIONS

Behloul, M. et al.; "Ductal® Pont du Diable footbridge, France", Tailor Made Concrete Structures—Walraven & Stoelhorst (eds) © 2008 Taylor & Francis Group, London, ISBN 978-0-415-47535-8, pp. 335-340.

*Primary Examiner* — Raymond W Addie
(74) *Attorney, Agent, or Firm* — Gazdzinski & Associates, PC

(57) ABSTRACT

A modular bridge is formed from a plurality of bridge modules. In one embodiment, the bridge includes: a first longitudinal compression member that is, in use, at an upper part of the bridge cross-section; a second longitudinal compression member that is, in use, at a lower part of the bridge cross-section; a structural lateral element for forming a deck of the bridge or for supporting deck elements of the bridge;
(Continued)

a shear element for carrying a shear load; and a tension member applying a compressive force to one of the longitudinal compression members such that when in use the other of the longitudinal compression members forms a main compression element for the bridge and the tension member forms a main tension element for the bridge. The bridge modules form segments of the length of the bridge and each bridge module is of a one-piece construction.

20 Claims, 5 Drawing Sheets

(51) Int. Cl.
*E01D 15/00* (2006.01)
*E01D 15/10* (2006.01)
*E01D 21/06* (2006.01)
*E01D 101/40* (2006.01)

(58) Field of Classification Search
USPC .. 14/2.4, 3–9, 13–26, 69.5, 71.1, 72.5–73.1, 14/74.5–78; 52/693
See application file for complete search history.

(56) References Cited

U.S. PATENT DOCUMENTS 4,998,332 A * 3/1991 Dacey, Jr. ..... B62D 25/163 29/525.02
5,341,533 A * 8/1994 Seitz ..... B65G 69/287 14/69.5
5,457,839 A * 10/1995 Csagoly ..... E01D 19/125 14/73
5,471,694 A * 12/1995 Meheen ..... E01D 2/04 14/73
5,570,486 A 11/1996 Wiedeck
5,679,432 A * 10/1997 Holmquest ..... B32B 5/18 428/318.4
6,151,743 A * 11/2000 Church ..... B29C 53/585 14/73
6,557,201 B1 * 5/2003 Bowman ..... B29C 70/443 14/2.4
D579,575 S * 10/2008 Lockwood ..... D25/113
7,475,446 B1 * 1/2009 He ..... E01D 2/02 14/73
2014/0345069 A1 * 11/2014 Tirimanna ..... E01D 15/133 14/73.1

FOREIGN PATENT DOCUMENTS

FR 2 286 240 A1 4/1976
GB 400887 A 11/1933
GB 612753 A 11/1948
GB 2228301 A 8/1990
GB 2476843 A 11/2011
WO 2005/012644 A1 2/2005
WO 2011/141385 A1 11/2011
WO 2013/095087 A1 6/2013

* cited by examiner

MODULAR BRIDGE, A BRIDGE MODULE FOR A MODULAR BRIDGE, AND METHODS FOR ASSEMBLY

PRIORITY AND RELATED APPLICATIONS

This application is a National Stage Application of, and claims priority to, under 35 U.S.C. 371, International Application No. PCT/GB2015/050967, filed Mar. 30, 2015, which claims the benefit of priority to British Patent Application Serial No. 1406153.5 filed Apr. 4, 2014, the priority benefit of which is also herein claimed, each of the foregoing being incorporated herein by reference in its entirety.

COPYRIGHT

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

BACKGROUND

1. Technological Field

The disclosure relates generally to modular bridge design, and particularly in one exemplary aspect, a modular bridge constructed from a plurality of bridge modules and methods for the assembly of the modular bridge.

2. Description of Related Technology

Modular bridges are bridges that are constructed by joining a plurality of prefabricated bridge modules to form the bridge. An exemplary modular bridge is described in WO 2013/095087 in which prefabricated concrete railing modules are assembled in series to create two longitudinal railings for the bridge. A deck is then laid on inwardly projecting edge-strips of the railings.

Modular bridge construction techniques are typically used for small to medium sized bridges, such as footbridges or single-carriageway bridges, and are commonly used in rural areas when bridge replacement projects are undertaken. Modular bridge construction may also be used to build, for example, motorway gantries or sign holders.

The locations for footbridges and gantries in particular are not always accessible by road, and a significant number of them are very difficult to access with any form of lifting plant. Furthermore, when replacing such bridges, the replacement bridge must often be stronger than the original (which may be decades or centuries old) in order to meet modern regulations. This means that the new bridge is larger and heavier than the original bridge when the new bridge has a conventional design. As a result extensive works are often required when replacing bridges since the original foundations may need strengthening or replacement and the access routes used to install the original structure may no longer be adequate, if even still in existence.

When installing footbridges where there has never been a bridge in the past, access routes are often even more constrained. In these situations, access is a significant cost and, in some cases, can exceed the cost of the bridge itself.

SUMMARY

In a first aspect, a modular bridge is disclosed. In one embodiment, the modular bridge is formed from a plurality of bridge modules, the bridge having a longitudinal direction along the spanning direction and including: a first longitudinal compression member that is, in use, at an upper part of the bridge cross-section; a second longitudinal compression member that is, in use, at a lower part of the bridge cross-section; a structural lateral element for forming a deck of the bridge or for supporting deck elements of the bridge; a shear element for carrying a shear load; and a tension member applying a compressive force to one of the longitudinal compression members such that when in use the other of the longitudinal compression members forms a main compression element for the bridge and the tension member forms a main tension element for the bridge; wherein the bridge modules form segments of the length of the bridge and each bridge module is of a one-piece construction, this single piece including: a segment of the first longitudinal compression member of the bridge; a segment of the second longitudinal compression member of the bridge; a segment of the structural lateral element; and a segment of the shear element; and the bridge modules being arranged to support a portion of the tension member.

In effect, the completed bridge has similar structural characteristics to an I-beam, with the two flanges of the I-beam being formed by the two longitudinal compression members and the web of the I-beam being formed by the shear element. The structural lateral element provides additional stability and also forms or supports the deck, which carries the loading on the bridge for example pedestrians or vehicles. The tension member provides a post-tensioning force, allowing the bridge modules and interfaces to be constructed to carry predominantly a compression and shear loading. This bridge can be readily constructed out of parts that are each relatively lightweight and maneuverable. As discussed below, the bridge modules may advantageously be made from composite materials and this means that they can be lifted and assembled by hand and the bridge can be installed without the need for large machinery. Thus, the proposed bridge is better suited for construction in less-accessible locations that known bridge designs.

In a second aspect, a bridge module for a modular bridge is disclosed. In one embodiment, the bridge module is utilized with a bridge having a longitudinal direction along the spanning direction, the bridge module being of one-piece construction and forming a segment of the length of the bridge; wherein the one-piece construction includes: a segment of a first longitudinal compression member of the bridge; a segment of a second longitudinal compression member of the bridge; a segment of a structural lateral element of the bridge; and a segment of a shear element of the bridge; and the bridge module being arranged to support a portion of a tension member; such that when multiple bridge modules are assembled they will form a bridge having a first longitudinal compression member that is, in use, at an upper part of the bridge cross-section; a second longitudinal compression member that is, in use, at a lower part of the bridge cross-section; a structural lateral element for forming a deck of the bridge or for supporting deck elements of the bridge; and a shear element for carrying a shear load; and such that the tension member, when tensioned, will apply a compressive force to one of the longitudinal compression members with the tension member forming a main tension element for the bridge and the other of the longitudinal compression members forming a main compression element for the bridge.

The modular bridge and bridge module will provide a great degree of flexibility in the ways in which it can be constructed. Various techniques can be used for assembly of the bridge as discussed further below.

By one-piece construction, it is meant that each module is formed of only one part. For example, by molding as a single piece. The one-piece module preferably incorporates all the structural elements required to form the bridge, aside from the tension member. Thus, embodiments described herein do not require any assembly of the individual bridge modules on site or after manufacture; they may always exist as one unitary part constructed of a single material.

The bridge modules (and hence the bridge) may be generally U-shaped in cross-section with the segment of the structural lateral element forming the base of the U and segments of two shear elements forming the sides of the U. With this arrangement the segment of the longitudinal compression member that forms the main compression element of the bridge may be at an upper part of the U-shape. Preferably there are two such segments at the upper parts of both sides of the U-shape. The segment of the longitudinal compression member that is compressed by the tension member may be at a lower part of the U-shape, for example at a joining point of the base of the U-shape and the side of the U-shape. Preferably there are two such segments symmetrically arranged at a lower part of the bridge, for example at the two joining points of the base of the U-shape and the sides of the U-shape.

It should be noted that for convenience this bridge is described as carrying a vertically downward load, and hence the main compression element of the bridge is at an upper part and the main tension element of the bridge is at a lower part. It will of course be understood that in the case of a mainly horizontal loading or mainly vertically upward loading then the tension and compression elements may be re-oriented appropriately. Whilst a vertically downward load is most common for supporting a load under the influence of gravity, in some situations, for example due to wind loading or loading from buoyancy, the main loading may be in other directions.

The tension member may be located at a similar height, with the bridge modules in use for a vertical loading, to the lateral structural element. Preferably the longitudinal compression member that is compressed by the tension member is at about the same height, with the bridge modules in use for a vertical loading, as the tension member.

Since the module has a one-piece construction then each element of the module is formed integrally with adjacent elements and structurally coupled thereto. In one example construction the segments of the first and second longitudinal compression members are formed integrally above and below the segment of the shear element (above and below referencing the orientation of the bridge module when in use for a bridge with a vertical loading), and the segment of the structural lateral element is formed integrally adjacent to the segment of one of the longitudinal compression members, preferably the lower longitudinal compression member. Where there are pairs of first and second longitudinal compression members then a pair of segments of the two second longitudinal compression members may be formed integrally at either side of the segment of the structural lateral element, a pair of segments of two shear elements may be formed extending in a direction away from a plane of the segment of the structural lateral element with each shear element formed integrally with one of the pair of segments of the two second longitudinal compression members, and a pair of segments of the two first longitudinal compression members may be formed integrally with the two shear elements at a location placed away from the plane of the segment of the structural lateral element.

In one or more implementations, the bridge modules are formed from a composite material and may be molded in one piece. Advantageously, the use of multiple similar modules means that only one mold is required to manufacture the bridge. Modules made with just one mold shape can make bridges with a range of spans, simply by adding extra modules. Thus, the same tooling can be used for every bridge. If modules with different lengths are required then end stops may be put in the mold to make exact lengths. This delivers a big cost advantage over known composite bridges. The use of composite materials also allows for variations in strength and stiffness across the profile of the module. Thus, areas of increased strength and stiffness can be included to form the segments of the longitudinal compression members. This can be achieved not only through increased material thickness but also through changes in the amount of fibers and the type of lay-up used.

The composite material may be a fiber reinforced resin, in which the fiber is most preferably glass fiber or carbon fiber. The fiber may be in the form of a woven cloth or a unidirectional cloth, although other arrangements are possible. The use of composite materials, such as fiber reinforced resin, means that the bridge modules are exceptionally light and may be easily maneuvered by workers on site. Composite materials may also be easily molded in complex shapes, facilitating the one-piece construction. Techniques and materials known from the boat building industry may be used when designing the one-piece molding for a composite module.

In one or more implementations, at least two symmetrically-arranged tension members are used, which is particularly preferred when there is a corresponding pair of first or second longitudinal compression members. This allows the compressive force in the bridge to be more accurately controlled, so as to maintain relatively uniform and centered compression to reduce the risk of lateral buckling of the bridge. The tension members may be tension cables, for example steel cables, stainless steel bars, or fiber reinforced rods.

Each tension member preferably applies compression to the lower longitudinal compression member(s) of the bridge, and the tension member(s) may be located at about deck level, for example at about the level of the structural lateral element. By this configuration, the compression applied by the tension member(s) acts as a prestressing load for the bridge, which thus behaves in a similar manner to a post-tensioned concrete beam. The tension in the tension member is applied after the modules are assembled together. Post-tensioning the bridge puts all connections between the modules into compression. This means that the modules and any couplings joining them are much simpler to assemble on site than the connections currently used on modular bridges and composite bridges. Less complexity means reduced risk.

The modules may have side parts comprising side panels and side-rails, wherein the side panels generally form the segments of the shear elements and the side rails generally form the segments of the upper longitudinal compression members. When the plurality of the bridge modules are arranged adjacent one another then the side rails form side-rails of the bridge, which are the main compression members of the bridge. The side rails could in some examples form hand rails of the bridge, or they may be rails at a higher level acting mainly as a structural component.

The segments of the shear elements, for example the side-panels, may be textured or perforated to provide a visible pattern. Advantageously, when molded composite parts are used, the form of the segments of the shear elements can be adjusted by the use of inserts of the like without changing the main mold, hence keeping the advantage of the use of a single mold, whilst also allowing for great variation in the appearance of the end product. Perforations in the segments of the shear elements are possible because the side-rails serve as the main compression members for the bridge and the segments of the shear elements hence need not carry significant load. Whilst the segments of the shear elements serve to carry shear loading, this is a lesser loading than the compressive load and so the overall strength of the bridge is hence not adversely affected by such perforations. Moreover, the shear loading decreases toward the center of the span, where the bending moment is maximum. In view of this, the perforations may constitute over 50% of the area of the segments of theshear elements in some modules, for example with the degree of perforation increasing toward the center of the span of the bridge. The perforations may additionally be filled with a material that is visually distinct from the material of the segments of the shear elements, such as colored resin. Different perforations may be filled with differently colored materials.

Each bridge module may comprise flanges at its longitudinal ends for engaging with corresponding flanges of the adjacent bridge module(s). The flanges may extend along at least the outer side of the segment of the shear element and across the segment of the structural lateral element. That is to say, for a U-shaped module, the flanges preferably extend away from the location of the deck surface about the outside of the U-shape.

The bridge modules may be coupled to one another by one or more shear transfer joint(s), which may be provided at multiple points along the flanges. The shear transfer joint is preferably a mechanical fixing and in particular may be a coupling as described below. A shear joint using mainly compression allows the flanges to be thinner. Thus, the flanges of the bridge modules preferably include recesses for receiving a core of complementary shape. For example the core may be a ball-shape and the recesses may be cup-shaped. The recesses are at the outer sides of the flanges, so that when two modules are joined a core may be trapped in the recesses between the flanges. The shear joint may be held by the compressive force applied with the tension member. In some examples a further coupling mechanism is used to apply a compressive force locally. This can allow the advantage of using the shear joint to provide some tension carrying ability for use when before the tension member is fitted (for example during assembly of the bridge) or if the tension member fails.

The use of shear transfer joints means that shear loads are effectively transferred between modules. Mechanical fixings are preferred to glue or the like, since this provides a more reliable and consistent coupling, especially when the bridge is being assembled on site where accurate control of the quality of glued fixings is harder to attain. The shear couplings preferably have sufficient strength when carrying loads in tension and compression to allow the bridge modules to be joined and maneuvered together before the tension member is fitted or before it is pretensioned. This can further increase the flexibility of the design in terms of the way that it can be assembled and moved into place at the desired location.

The bridge modules preferably have attachment points for attaching wheels. This allows temporary wheels to be attached to the bridge modules to allow them to be moved easily around the site without specialist lifting apparatus. In one preferred embodiment, the integral attachment points are provided by through-holes for receiving the tension member(s). These through holes may be in the flanges, for example at corners of the U-shape where the deck and side parts join.

The deck of the bridge may be formed integrally with the segments of the structural lateral element, or it may be a separate part fitted after assembly of the bridge, such as an in fill panel. The deck may comprise a grip surface, which can be applied after forming of the bridge modules. Alternatively, the deck may comprise molded formations providing the grip surface.

Preferably the bridge modules each have a longitudinal length of less than 2 meters, and preferably of between 0.5 meters to 1.5 meters. This length allows the bridge modules to be loaded into a small van or trailer, thus allowing the bridge to be assembled in sites having poor accessibility that might prohibit larger trucks or lorries from gaining access.

Each bridge module preferably has a mass of less than 500 kg, and more preferably a mass of under 200 kg and most preferably a mass of under 100 kg. This mass allows the bridge modules to be moved manually using a trolley or on wheels as mentioned above. As a result, large lifting plant, such as a crane or the like, is not required to maneuver the bridge modules around the site.

In one or more implementations, the modular bridge is a footbridge, although it will be understood that the invention is not limited to application as a foot bridge and the modular bridge of the invention may have other applications, providing particular advantages for bridges that need to be installed quickly and/or in hard to access areas, or need to be conveyed by light vehicles and installed by hand with minimum mechanical assistance. For example, bridges for military use, for temporary use in replacing damaged bridges after flooding or the like, and so on. Since the bridge has a modular construction then in some circumstances it could be used temporarily in one location with one span, and then disassembled and rebuilt at another location, with a different span, by using a greater or fewer numbers of modules. Moreover, in the current context the term 'bridge' is intended to refer to an element capable of carrying a load whilst spanning and hence capable of carrying a bending moment as well as vertical load. Thus, the term 'bridge' also includes not only footbridges, road bridges and the like, but also extends to cover gantries for road signs or overhead cranes. Structural elements that spread load but do not span are not considered to be bridges.

The bridge may have end modules of different design to the other modules. For example, the end modules may be specially adapted to spread the load applied when the tension member is tensioned. In one embodiment the end modules have a thickened outer flange for this purpose.

The bridge may have additional tension members, for example there may be two tension members (or two sets of tension members) to apply compression to both of the longitudinal compression members of the bridge. The bridge may have additional structural lateral elements, for example there may be one structural lateral element forming a deck or a support for a deck, and a second structural lateral element forming a 'roof' or top enclosure, such that the bridge has a box cross-section.

The bridge may be easily transported in disassembled form and the present disclosure further provides, in a third aspect, a kit of parts for forming a modular bridge. In one embodiment, the kit of parts comprising a plurality of bridge modules as described above, the plurality of bridge modules being adapted to be arranged adjacent one another such that the segments of the bridge modules form a bridge having a longitudinal direction along its spanning direction and including: a first longitudinal compression member that is, in use, at an upper part of the bridge cross-section; a second longitudinal compression member that is, in use, at a lower part of the bridge cross-section; a structural lateral element for forming a deck of the bridge or for supporting deck elements of the bridge; and a shear element for carrying a shear load; wherein the bridge modules are adapted to receive a tension member that, when tensioned, will apply a compressive force to one of the longitudinal compression members.

The kit of parts need not necessarily include the tension member, as suitable tension members are commonly available and might be sourced separately. However, in some examples, the kit of parts includes the tension member.

The kit of parts may further comprise at least one set of wheels adapted to engage with the bridge modules. The wheels may be adapted to engage with integrally formed wheel attachment points on the bridge modules, and preferably with through-holes that are for receiving the tension member. The wheels facilitate easy movement of the bridge modules of the kit when assembled on site.

Other features of the modules in the kit of parts may be as described above.

Viewed from a fourth aspect, the present disclosure provides a method of assembly for a modular bridge. In one embodiment, the method further includes: providing a plurality of bridge modules, each bridge module being of a one-piece construction and forming a segment of the length of the bridge; wherein the one-piece construction includes: a segment of a first longitudinal compression member of the bridge; a segment of a second longitudinal compression member of the bridge; a segment of a structural lateral element of the bridge; and a segment of a shear element of the bridge; aligning the plurality of bridge modules adjacent one another to form a bridge having a first longitudinal compression member that is, in use, at an upper part of the bridge cross-section; a second longitudinal compression member that is, in use, at a lower part of the bridge cross-section; a structural lateral element for forming a deck of the bridge or for supporting deck elements of the bridge; and a shear element for carrying a shear load; fitting a tension member to the modules and tensioning the tension member so as to apply a compressive force to one of the longitudinal compression members with the tension member forming a main tension element for the bridge and the other of the longitudinal compression members forming a main compression element for the bridge.

The method may form a modular bridge as described above. A significant advantage of the modular bridge described herein is the diversity of ways in which the modular bridge may be assembled, allowing suitable construction techniques to be applied depending upon the specific requirements of the site. The bridge can be assembled away from the installation location (but preferably close by), making what is in effect a lightweight prestressed beam that can be maneuvered by a small crane or even winched by hand in some cases. With this option the tension member may be pretensioned before the bridge is moved to the required location, or in some cases, for example when the individual modules are joined by shear joints or other couplings of appropriate strength, the bridge, or parts of the bridge, may support its own weight even without the tension member. The method may hence comprise coupling the bridge modules together with shear joints, for example mechanical fixings such as the couplings described below. The bridge could then be assembled away from the installation location in one piece or in sections, then maneuvered to the required location before being completed by fitting and tensioning the tension member.

Using one assembly technique, the method may comprise: joining the aligned bridge modules to one another; and then later positioning the joined bridge modules in their final position as a bridge module unit that forms part of the span of the bridge or the complete span. Namely, the bridge can be assembled near to its final position, for example on flat ground nearby, and then finally moved into position once all the parts are assembled. This minimizes the time that workers need to clear the area below the bridge whilst it is installed. This is important if, for example, the bridge will span a road or train track where disruptions to traffic flow must be minimized.

The positioning step may comprise maneuvering the joined modules by crane, by pulling the joined modules across the required span, either with lifting or perhaps with the ends of the joined modules being supported on the ground, optionally with a trolley or wheels.

The connections for the tension member may be used when maneuvering the joined bridge modules. For example, step of positioning the joined bridge modules may comprise: anchoring a guide tension member at suitable a location near the required bridge location; engaging the joined bridge modules with the guide member; sliding the joined bridge modules along the guide tension member from the other longitudinal side of the final position of the modules into their final position. The step of engaging the guide tension member may comprise running the guide tension member through through-holes in the bridge modules.

If the step of positioning is performed before the step of tensioning, then these through-holes may be the same through-holes that are used to receive the tension member (although separate holes could be provided). Furthermore, the guide tension member may be the tension member of the constructed bridge. In this case, the bridge module unit can be slid into its final location and immediately tensioned.

In an alternative technique, the bridge may be jacked out into the required position. Thus, positioning the bridge may comprise jacking the joined bridge modules from one longitudinal side of the bridge to the other, for example pushing it out over the required span whilst the bridge supports its own weight in cantilevered fashion. During the jacking the joined bridge modules may be held just by shear joints (if these joints can carry a suitable load), or it could have the tension member fitted and pre-tensioned.

In yet a further alternative, instead of sliding the bridge module unit into place as described above, the step of positioning could instead comprise lifting the joined bridge modules as a unit into their final position, for example using a crane. When composites are used the bridge is light enough for only a small crane to be required. Again, the joined bridge modules may be held just by shear joints (if these joints can carry a suitable load), or it could have the tension member fitted and pre-tensioned.

Using another assembly technique, the step of aligning the plurality of bridge modules may comprise joining the bridge modules to one another, starting from a first of the bridge modules that is fixed relative to the ground at one side of the span, and extending across the span module-by-module by attaching additional modules at the free end with the bridge extending and supporting its own weight in cantilever fashion. This technique may be of use if the area on either side of the bridge not easily accessible for vehicle or workers, or if there is insufficient space to assemble the bridge nearby.

In order to minimize the load on the bridge when it is cantilevered, it may be desirable to construct the bridge from both sides simultaneously. The step of aligning the plurality of bridge modules may therefore further comprise joining further bridge modules to one another sequentially in a cantilever fashion, starting from a second of the bridge modules that is fixed relative to the ground such that the bridge modules cantilevered from the first bridge module and the bridge modules cantilevered meet at an intermediate location along the final span of the bridge.

Using yet a further alternative technique, the step of aligning the plurality of bridge modules may comprise: fastening a guide tension member at a location on one longitudinal side of a final position of the modules; and for each bridge module: running the guide tension member through a holes in the bridge module; and sliding the bridge module along the guide tension member from the other longitudinal side of the final position of the modules into its final location. Preferably, the guide tension member is the tension member used for the final constructed bridge.

In this technique, the bridge modules are run along the guide tension member in a manner akin to beads being slid along a thread. This technique is useful when space around the bridge site is limited, and where it is not possible to access the area below the bridge.

As noted above, it can be important to have a good coupling between modules of the bridge, for example to provide a shear joint that can also carry other loads. There are challenges when mechanically fixing composite materials since they may be susceptible to failure at stress concentrations. The inventors have devised a connector for use with the bridge and bridge modules described above. This connector and the related method of connecting are also considered inventive in their own right.

Thus, viewed from a further aspect, the present disclosure provides a connector for joining two composite articles. In one embodiment, the connector comprising: a core to be received within recesses at concave sides of a pair of formations in the composite articles, the recesses being sized and shaped to fit a part of the core; and a mechanism for compressing the formations of the composite articles against the core.

The composite articles may be fiber reinforced plastic, for example glass fiber reinforced plastic. The connector joins the two composite articles with the composite material at the joint being loaded generally in compression. This can allow shear forces to be transferred between composite articles more effectively that conventional shear transmitting connections and with significantly reduced risk of failure of the composite. Shear joints can be made by gluing composite articles, but gluing is not ideal for many purposes since the joint can be adversely affected by environmental conditions (temperature, moisture and so on) both during manufacture and during later use, and furthermore since accurate control over the strength and quality of the joint is difficult, particularly when joints are made on site. Mechanical fixings avoid these issues, but have their own problems, including the risk of stress concentration and tearing of composite materials. With conventional mechanical fixings, shear is transmitted primarily by friction between the composite articles. This is achieved by compressing them tightly against one another, for example using bolts. The bolts themselves then serve as a secondary shear joint in the event that the friction force is overcome. In this event, however composite materials are prone to localized crushing due to the high forces being applied to a small surface area. This can lead to the composite article tearing and ultimately to failure of the joint. In accordance with the connector of this aspect, if the frictional force is overcome, then the composite articles instead bear on the surface area of the core, which is larger than the surface area of the bolt and this hence reduces the risk of localized crushing.

The connector may be embodied as a connection system including the core and the corresponding formations in the composite articles, and hence including the composite articles themselves. However, the connector is also considered inventive without the composite articles.

The mechanism for compressing the formations of the composite articles may be provided by some outside mechanism for compressing the two composite articles together. For example, in the case of a modular bridge as described above the compression force may be provided by the tension member. Alternatively, there may be a coupling mechanism for applying a compressive force locally to the connector.

Thus, the connector may include a coupling mechanism for compressing the formations against the core. The coupling mechanism may include a threaded connector for extending through the formations and applying the compressive force to outer parts of the formations. The threaded connector may pass through the core. In one example the connector includes two cup-shaped members for engaging protrusions at convex sides of the pair of the formations of the two composite articles such that the concave sides of cup-shaped members face the core; and the coupling mechanism is arranged to compress the two cup-shaped members against the formations to thereby compress them against the core.

The core may be a ball-shape, such as a substantially spherical or ellipsoidal shape. However, the core is not limited to those shapes and may be any suitable shape for engaging with a complementary shaped recess in the formation of the composite article. For example, the core may be a cone, truncated cone, pyramid, truncated pyramid or other solid shape. Typically the core is symmetrical such that the two recesses are of the same size and shape and each hold a half of the core.

Preferably, the core comprises a through-hole and the coupling mechanism comprises a tension member for extending through the through-hole, the two composite articles and optionally through the two cup-shaped members when they are present, the tension member being adapted to apply the compressive force. Alternatively, the coupling mechanism may comprise two tension members extending from the core, which may be formed integrally with the core or may be secured in blind holes at either side thereof.

The tension member(s) may comprise a threaded rod (for example a bolt) such that the coupling mechanism will apply the compressive force using threaded couplings fitted to the rod(s) for holding the cup-shaped members against the outer convex parts of the cup-shaped formations. The threaded rod may be the threaded connector referenced above. Thus, there may be a threaded connector passing through a hole in the core with two nuts or a nut and a head of the bolt holding the cup-shaped members in place. Alternatively, the tension member may comprise a threaded rod and the two cup-shaped members may each include an internal screw thread for engaging the threaded rod.

Preferably the parts of the connector are formed from metal, such as stainless steel.

Viewed from a yet further aspect, the present disclosure provides for an assembly of two composite articles joined by the connector described above. In one embodiment, the assembly comprising: the two composite articles, each having a formation formed thereon; and a connector as described above, wherein the core of the connector is received within recesses at concave sides of the formations of the composite articles, and wherein a mechanism compresses the formations of the composite articles against the core. The connector of this aspect may have any or all optional features described above.

Viewed from a yet further aspect, the present disclosure provides a method for joining two composite articles. In one embodiment, the method comprising: providing a core; providing a pair of formations on the two composite articles; the formations each including recesses with size and shape to fit a part of the core; locating the two formations adjacent one another, with the recesses facing each other and the core placed within the recesses; and applying a compression load such that the formations press against the core.

The compression load for compressing the formations of the composite articles may be provided by some outside mechanism for compressing the two composite articles together. For example, in the case of a modular bridge as described above the compression force may be provided by the tension member. Alternatively, the method may include using a coupling mechanism to apply the compressive force locally.

The compressive force may be applied by a threaded connector of coupling mechanism, the threaded connector extending through or both of the formations and applying the compressive force to outer parts of the formations. In one example the connector includes two cup-shaped members for engaging protrusions at convex sides of the pair of the formations of the two composite articles such that the concave sides of cup-shaped members face the core; and the method includes compressing the two cup-shaped members against the formations to thereby compress them against the core.

The method may use a core of any shape as described above.

Preferably, the core comprises a through-hole and the method includes passing a tension member of the coupling mechanism through the through-hole and the two composite articles, the tension member being adapted to apply a compressive force to the two cup-shaped members. Alternatively, the method may use a coupling mechanism comprising two tension members extending from the core, which may be formed integrally with the core or may be secured in blind holes at either side thereof.

The tension member(s) may be as described above in relation to the connector.

As will be understood from the discussion above, embodiments include a modular bridge as described above where the modules are coupled to one another by a connector as described above. An example method may comprise assembling a bridge as described above and using a connection method as described above to form a shear joint between the modules.

Certain embodiments of the present disclosure will now be described in greater detail by way of example only and with reference to the accompanying drawings, in which.

Figure 1:
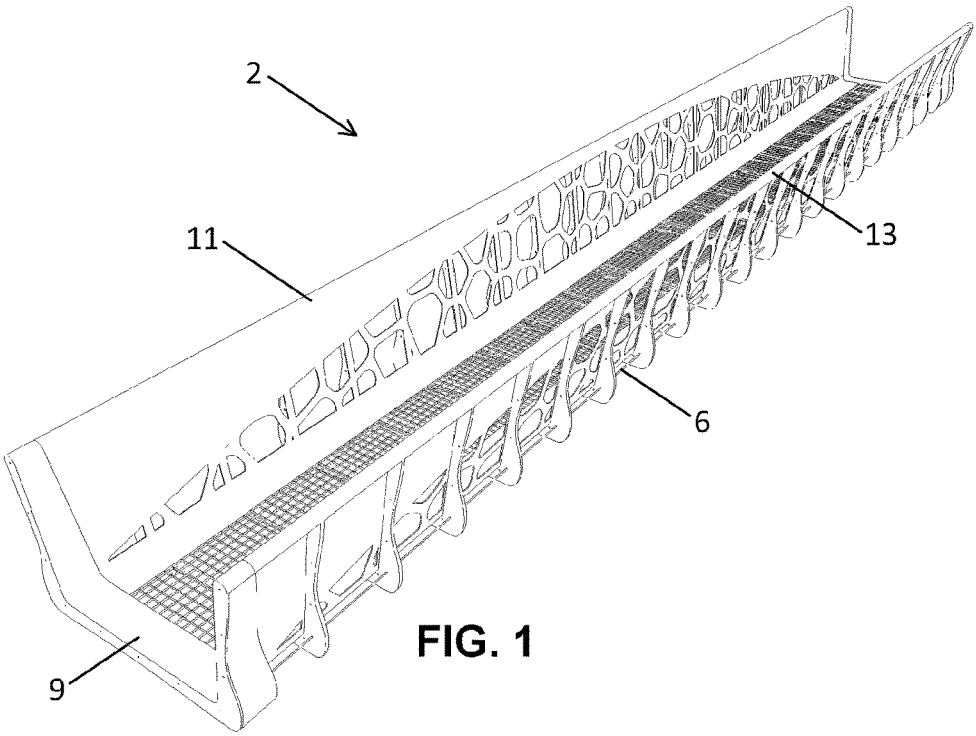
FIG. 1 is a perspective view of a modular bridge.
Figure 2:
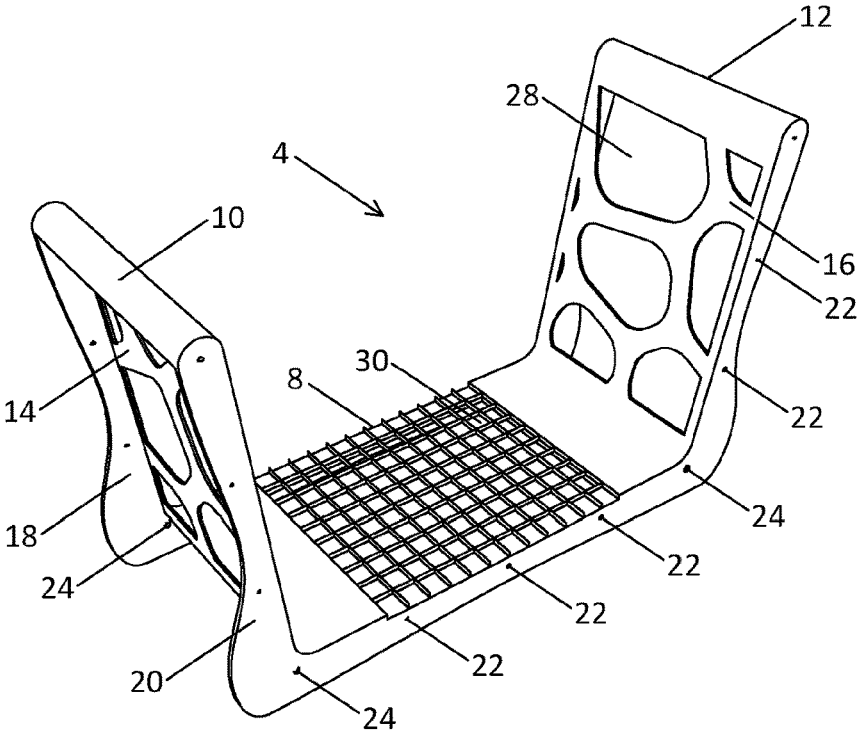
FIG. 2 is a perspective view of a bridge module of the modular bridge.

FIG. 1 shows a modular bridge 2 constructed from a plurality of bridge modules 4 (shown individually in FIG. 2). The modular bridge 2 is constructed by abutting the bridge modules 4 in a longitudinal direction (i.e. the direction in which the bridge 2 spans) and post-tensioning them on-site using two tendons (also referred to as tension members) 6.

The bridge modules 4 themselves are formed off-site. They have a one-piece construction and are formed in a single moulding out of a composite material. All of the mid-span bridge modules 4 (the bridge modules 4 not at the very ends of the bridge) share an identical mould tool, which reduces their manufacturing cost. Exact bridge spans can then be created by putting an end stop into the standard mould to make shorter bridge modules 4.

For example, in the present embodiment, the mid-span bridge modules 4 are manufactured with a longitudinal length of about 1 meter along the span (this is a nominal length which could be varied if required). A 20.5 meter bridge could then be produced using nineteen standard 1-meter bridge modules 4 and two custom-moulded 0.75-meter bridge modules 4.

The bridge modules 4 each have a deck (or deck support) 8 and side parts with a left side-rail 10 and a right side-rail 12. In general the term deck is used to describe the structural lateral element of the bridge. It should be appreciated that this part could form the deck surface (i.e. the surface for walking on in the example of a footbridge) or it could form a structural element that supports infill panels or the like that are the deck surface. The deck 8 and side-rails 10, 12 are adapted so that, when the modules are assembled to form the bridge 2, the decks of the individual bridge modules 4 align to form a continuous deck 9 of the bridge and the side-rails 10, 12 of the individual bridge modules 4 align to respectively form left and right continuous side-rails 11, 13.

The main load-carrying mechanism of the bridge 2 is the interaction between tension in the tendons 6, compression in compression members formed by stiffened sections at either side of the deck 8, and compression in the left side-rail 11 and the right side-rail 13 of the bridge. The compression members formed by stiffened sections at either side of the deck 8 may be formed by any suitable technique, for example by increasing the thickness of the moulded material, by increasing the amount of fibre reinforcement, or by adjusting the alignment of the fibre reinforcement. The two side rails form the main longitudinal compression member of the bridge. As will be discussed in greater detail later, certain loads during construction may be carried using only the interaction between tension and compression in the deck 8, the left side-rail 11 and the right side-rail 13, i.e. without use of the tendons 6.

Figure 3:
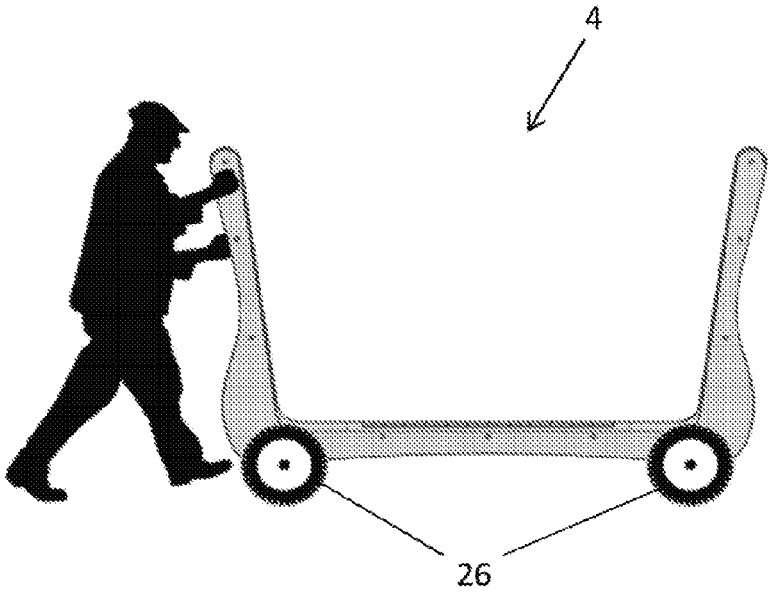
FIG. 3 is a side view showing a worker moving the bridge module.

The bridge 2 is post-tensioned meaning that the compression force from the tendons 6 is larger than in a beam bridge where tension is permitted. This means that the dominant critical failure modes are related to buckling. A critical failure mechanism is global buckling. Resistance to this may be improved by introducing curvature to the cross-section of the side-rails 10, 12 and side-panels 14, 16 (see FIGS. 2, 3 and 4).

The left and right side-rails 10, 12 are respectively connected to the deck 8 via left and right side-panels 14, 16. The side panels 14, 16 carry loads in shear and hence form the main shear element of the bridge. A forward flange 18 and a rearward flange 20 extend around the periphery of the longitudinal ends of the bridge module 4, i.e. extending outward from the side-panels 14, 16 and the deck 8. The flanges 18, 20 of the bridge module 4 each include means 22 for connecting the bridge module 4 to the opposite flanges 18, 20 of adjacent bridge modules 4. These are in the form of shear ball connectors 50, which will be discussed in greater detail later.

The bridge modules 4 are moulded from a fibre and resin matrix. Suitable fibres include glass fibres and carbon fibres, and suitable resins include epoxy, polyester, vinylester and methacrylate. In one example, Epoxidharz SR1124/SD893x resin, manufactured by Sicomin Epoxy Systems, is laminated with 600 gsm E-glass in approximately 60% ratio. However, other materials will be apparent to those skilled in the art.

Most preferably, woven or unidirectional cloth reinforcement is used due it its reliable properties. However, this bridge design still works well with very low grade materials. For example, even using polyester resin and chopped strand mat reinforcement, a span of over twenty meters can be achieved.

Figure 4:
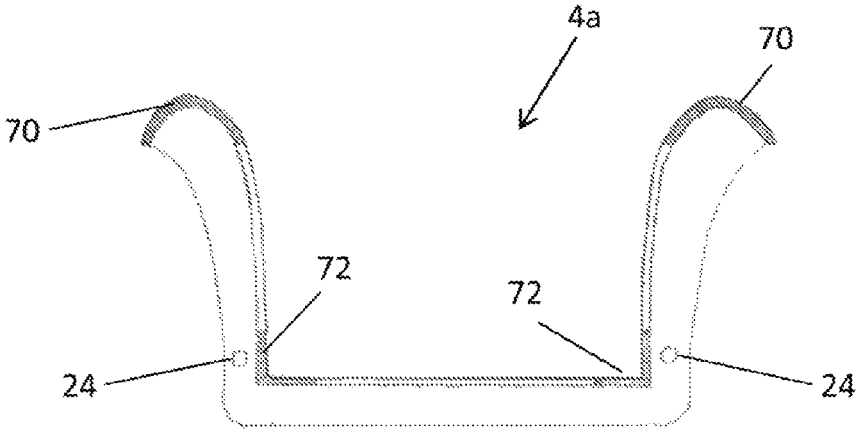
FIG. 4 is a side view showing a bridge module for a modular bridge showing stiffened regions.

In order to provide the required strength and stiffness for the longitudinal compression elements of the bridge 2, in this example formed by the two upper rails 11, 13 and parts of the deck structure 9, then the lay-up of the composite may vary for different parts of the cross-section of the module 4. Thus, as shown by the shaded areas in FIG. 4 there may be upper reinforced regions 70 that provide extra stiffness and strength to form upper longitudinal compression elements of the bridge 2, and lower reinforced regions 72 that provide extra stiffness and strength to form lower longitudinal compression elements of the bridge 2. The reinforced regions may be formed by increased fibres in the composite, by a different lay-up of fibres and so on. The thickness of the material could increase in the same regions, although this is not essential. FIG. 4 also shows variation in the cross-section of the module compared to the module of FIGS. 1 to 3. It will be appreciated that the proposed modular structure can be implemented in a variety of ways, of which these Figures show just two examples.

The bridge is lightweight and so may be prone to vibration. The deck 8 may optionally use a sandwich panel construction to increase the local stiffness by moulding upper and lower deck panels and installing a core material between the panels after moulding.

The bridge modules 4 are adapted to receive the tendons 6 by means of through-holes 24 formed in the front and rear flanges 18, 20. In alternative arrangements, the through-holes may pass through the body of the bridge modules 4 such that the tendons 4 are not exposed. The positions of the through-holes 24 correspond to the path of the tendons 6 when tensioned.

The through-holes 24 do not grip the tendons 6 and serve primarily as guides for the tendons 6 before they are tensioned. However, if the mid-span bridge modules 4 move lateral or vertical, then they will engage the tendons 6 and hence reduce the risk such movement. The through-holes 24 may also facilitate the bridge modules 4 being slid along the tendon 6 during assembly of the bridge, as will be discussed later.

Advantageously, wheels 26 can be clipped onto each bridge module 4 through these through-holes 24 to facilitate manual transportation around a work site. The use of composite materials means that the mass of each individual bridge module 4 is very low, typically under 200 kg. This allows a worker to manually transport the bridge modules 4 around the work site using the wheels 26 without the need for larger lifting plant, such as cranes.

Figure 5A:
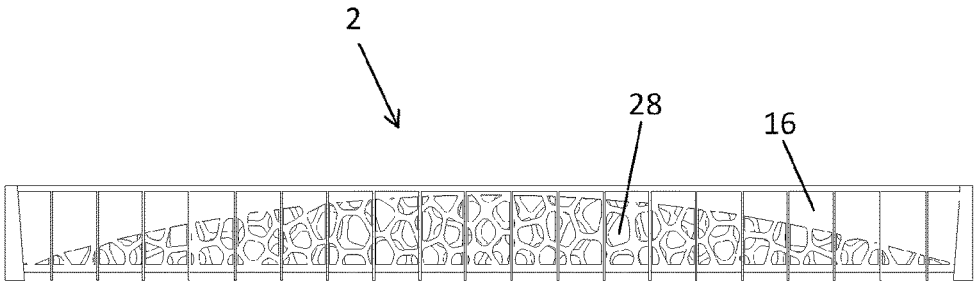
FIG. 5A to 5C show alternative webbing arrangements for side panels of the modular bridge.
Figure 5B:
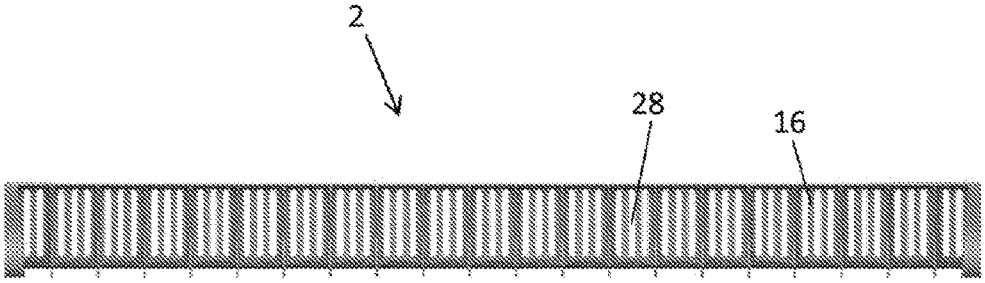
Figure 5C:
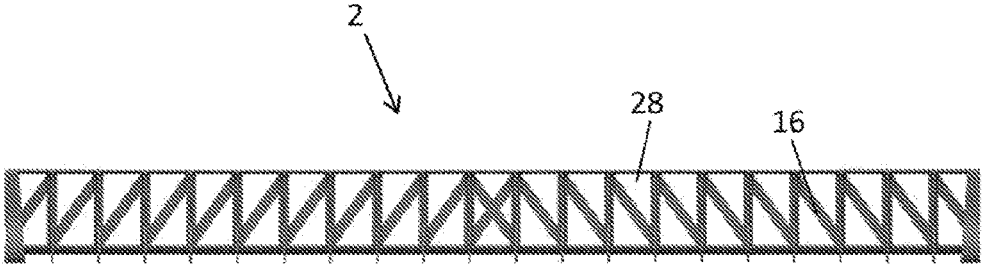

The bridge modules 4 can be customised via inserts in the mould, for example for form perforations 28, 30 in the side-panels 14, 16 or the deck 8. An exemplary deck perforation pattern is shown in FIG. 2, and exemplary side-panel perforation patterns are shown in FIGS. 5A to 5C.

The perforations 28 in the side-panels may further be filled using a material that is visually distinct from the material used to mould the bridge modules 4, such as coloured resins, to create a visible pattern.

When assembled, the bridge modules 4 are joined using shear ball connectors 50 (see FIG. 8), which together are of sufficient strength to allow the bridge 2 to carry, without the tendons 6, its own self-weight and restricted pedestrian access in the temporary construction and maintenance cases.

Figure 8:
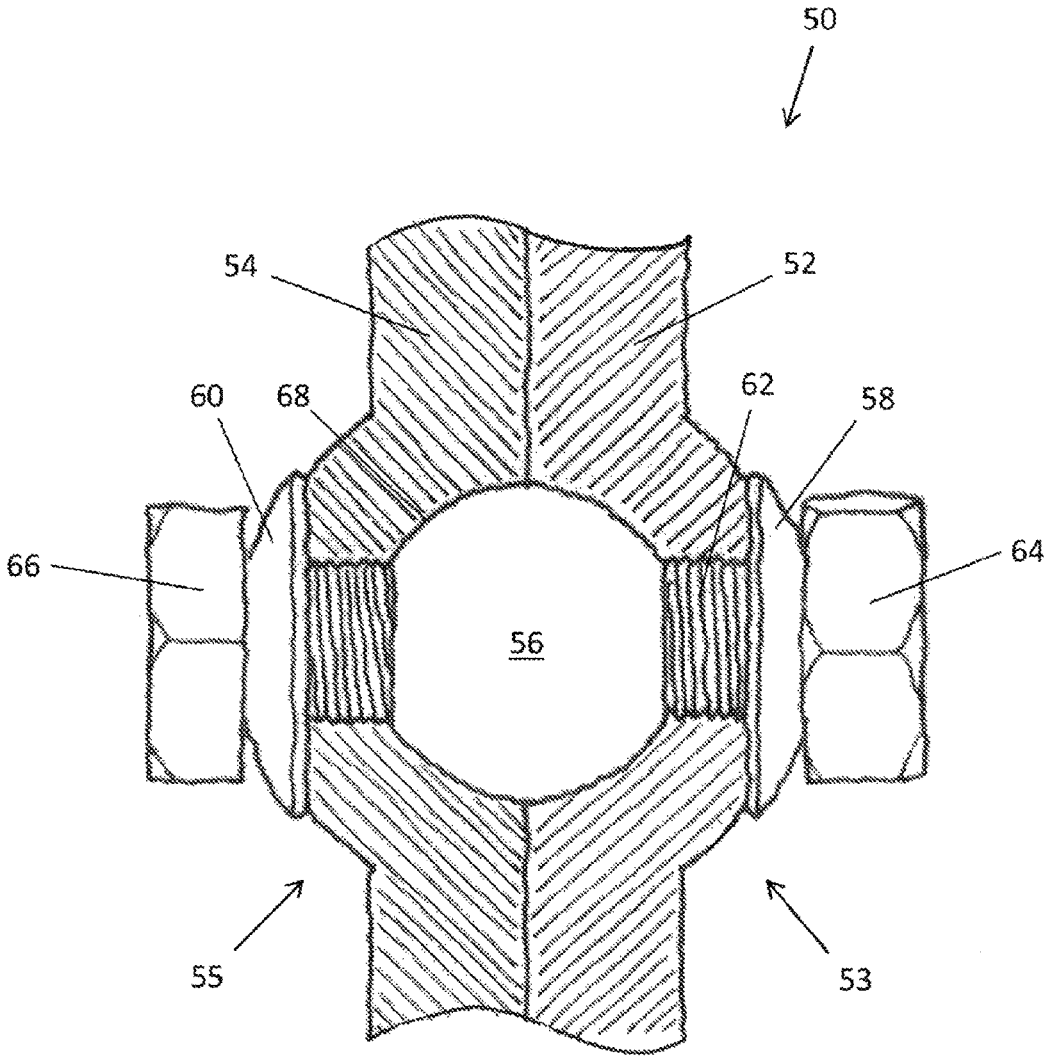
FIG. 8 is a sectional view showing a connector for use as a shear joint for connecting two bridge modules of the modular bridge.

FIG. 8 shows a cross-section through the connector 50 when it is in use to provide a joint between the flanges 52, 54 of two bridge modules 4. Each flange respectively includes a cup-shaped formation 53, 55 at the location of the joint. The shear ball connector 50 comprises a ball-shaped core 56 that is tightly received within a space formed by the cup-shaped formations 53, 55. The core 50 is a substantially spherical ball having an axial through-hole or bore formed therethrough. The connector 50 further comprises two cup-shaped clamping members 58, 60 that respectively engage the outer surfaces of the cup-shaped formations 53, 55 of the flanges 52, 54. A filler layer 68 can be used to account for any manufacturing tolerances and ensure the even spread of forces between the core 50 and the cup-shaped formations 53, 55. The filler layer 68 may be formed from, for example, a resin material poured into the recesses of the cup-shaped formations 53, 55, before they are clamped about the core 50. The resin filler layer 68 will cure and harden so that the resin and core 50 together completely fill the recesses. In an alternative to the use of a core 50 and filler layer 68 the core 50 may be cast in the recesses, for example using a resin, so that the core 50 perfectly fits the recesses.

A bolt 62 passes through the cup-shaped clamping members 58, 60, the flanges 52, 54 and the core 56, and a nut 64 tightened onto the end of the bolt 62 compresses the two clamping members 58, 60 between the nut 64 and the head 66 of the bolt 62, which in turn compress the cup-shaped formations 53, 55 against the core 56 of the connector 50.

Although the described embodiment utilises a nut 64 and bolt 62 to apply the compressive force, any suitable means for achieving this effect may be used. For example, two bolts may be used that engage an internal thread formed in the through-hole of the core 56. In another alternative arrangement, the cup-shaped clamping members 58, 60 may be formed integrally with the nut 64 and the head 66 of the bolt 62, respectively. It is also possible to dispense with the bolt and rely solely on the compression from the tendon 6 to hold the flanges 52, 54 against the core 56. In this case the number of parts is reduced but there is no longer any capability to hold a load in tension.

The shear ball connection 50 allows shear force to be transferred between adjacent bridge modules 4 more effectively because the shear force bear directly on the core 56, which has a larger surface area than the bolt. This prevents localised crushing of the composite, which can be caused by alternative shear connections, such as bolts. The transmission of shear via the core 56 of the shear ball connection 50 is a secondary shear connection, with shear being primarily transmitted between bridge modules 4 via the frictional forces arising due to the compression applied by the bolts 62 and the tendons 6.

The modular bridge 2 described above may advantageously be installed in a large number of ways, thus allowing for a high degree of flexibility when installing the bridge 2 in areas with restricted access.

Figure 6:
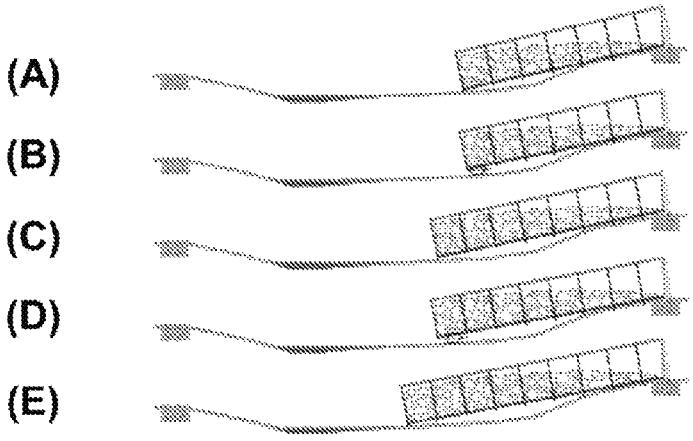
FIG. 6 shows a first method of installing the modular bridge.

A first method of assembly is shown in FIG. 6, which is suitable for when the bridge 2 can be accessed from below. The bridge modules 4 are sequentially assembled together and the bridge 2 hence forms a beam. This can be with or without the tension cable, since the shear connectors 50 will provide sufficient strength for the bridge 2 to support its own weight. The bridge 2 can then be pulled across the span, supported on the ground beneath. In a variation on this scheme the bridge modules 4 of the bridge 2 need not all be assembled together before the bridge 2 begins to be pulled across the span. Instead the bridge modules 4 can be added to the free end as the bridge 2 pull across. This might be helpful when there is restricted space.

The tendons 6 may either be fed through the bridge modules 4 as the bridge 2 is being assembled, or they may be fed through the bridge modules 4 once the bridge modules 4 have all be joined together. The tendons 6 are then post-tensioned to the desired tension.

This assembly technique allows for simple construction without large lifting plant and with a minimal work team. The bridge modules 4 are small enough to be moved via a small van and can be manoeuvred on site by a single worker using the wheels 24 discussed above. A small crane or possibly just a vehicle mounted winch or hand winch should be sufficient to pull the bridge across the span.

Figure 7:
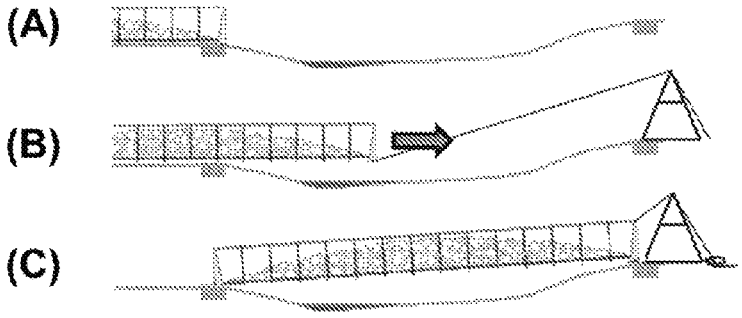
FIG. 7 shows a second method of installing the modular bridge.

A second method of assembly is shown in FIG. 7. In this technique, all or most of the bridge modules 4 are assembled close to the final position of the bridge. They are then joined together, using intermediate joints (e.g. the shear ball connections 50 described above) to form a unit. The tendons 6 are fastened at one longitudinal end of the span of the bridge, which is opposite to the side on which the bridge modules 4 have been assembled. The tendons 6 are then run across the space to be spanned by the bridge 2 and fed through the bridge modules 4.

The tendons 6 are then partially tensioned and the joined bridge module unit is slid along the tendons until it reaches its final position. Once in its final position, the bridge is fastened in place and the tendons are post-tensioned to the desired tension.

As above, the intermediate joints will typically remain in place, but may alternatively be removed or replaced by permanent joints. Furthermore, instead of using the tendons 6, temporary cables may be used to slide the bridge module unit into place, which are then removed and replaced by the tendons 6 to finally post-tension the bridge 2.

This assembly technique again allows for simple construction without large lifting plant and with a minimal work team. The bridge modules 4 are small enough to be moved via a small van and can be manoeuvred on site by a single worker using the wheels 24 discussed above. They are assembled on the flat and so no lifting equipment is required during assembly.

This technique is particularly advantageous where access below the bridge is not available, for example because the bridge spans a river, or where it is desirable to minimise the time during which it is accessed, for example where the bridge spans a road or train track. This assembly technique only requires the road of train track to be briefly suspended whilst the bridge module unit is slid into place, which can be done in a matter of hours rather than days.

Other techniques are possible, for example the tension cables might be fixed in place first, and then individual modules 'threaded' onto the cables from one end in a similar manner to making a string of beads, with the modules then being joined together once threaded onto the cable.

Further assembly techniques are also envisaged, for example if cranes are available, then the bridge could be assembled nearby and lifted (either using the intermediate joints or post-tensioned) into place using a crane. In a further alternative technique, the bridge could be built in a cantilevered fashion, in which bridge segments are sequentially added from fixed end points at the longitudinal ends of the bridge to meet at about the centre of the span of the bridge.

Whilst certain exemplary embodiments of the present invention have been described, it will be understood that the present invention is not limited to these embodiments but includes all embodiments falling within the scope of the present invention.

For example, in certain alternative embodiments, some or all of the mid-span bridge modules 4 may not include through-holes 24, but may instead be adapted to receive the tendons 6 by virtue of their shape, such as by leaving a clear space (e.g. a notch) through which the tendon 6 may pass.

Furthermore, whilst the shear ball connector 50 has been described for use in combination with composite bridge modules 4, it will be apparent to those skilled in the art that the connector 50 may be used in combination with other composite articles to achieve the same advantages.

The invention claimed is:

1. A modular bridge formed from a plurality of bridge modules, the modular bridge having a longitudinal direction along the spanning direction and including:

- a first longitudinal compression member that is, in use, at an upper part of the modular bridge cross-section;
- a second longitudinal compression member that is, in use, at a lower part of the modular bridge cross-section;
- a structural lateral element for forming a deck of the modular bridge or for supporting deck elements of the modular bridge;
- a shear element for carrying a shear load; and
- a tension member applying a compressive force to one of the longitudinal compression members such that when in use the other of the longitudinal compression members forms a main compression element for the modular bridge and the tension member forms a main tension element for the modular bridge;
- wherein the bridge modules form segments of the length of the modular bridge and each bridge module is of a one-piece construction, this one-piece construction comprising:
  - a segment of the first longitudinal compression member of the modular bridge;
  - a segment of the second longitudinal compression member of the modular bridge;
  - a segment of the structural lateral element; and
  - a segment of the shear element; and the bridge modules being arranged to support a portion of the tension member;
- wherein the bridge modules are formed from a composite material and are molded in one piece; and
- wherein the composite material is a fiber reinforced resin.

2. The modular bridge of claim 1, wherein the bridge modules are coupled to one another by one or more shear transfer joint(s).

3. The modular bridge of claim 1, wherein the shear transfer joints are connectors, each of the connectors comprising:

a core to be received within recesses at concave sides of a pair of formations in adjacent bridge modules;

wherein there is a mechanism for compressing the formations of the bridge modules against the core.

4. The modular bridge of claim 3, wherein each of the connectors comprises two cup-shaped members for engaging protrusions at convex sides of the pair of the formations of the two bridge modules such that the concave sides of cup-shaped members face the core.

5. The modular bridge of claim 3, wherein each of the connectors comprises a coupling mechanism for compressing the formations against the core, and wherein the core comprises a through-hole and the coupling mechanism comprises a local tension member for extending through the through-hole and the formations, the local tension member being adapted to apply a compressive force to compress the formations against the core.

6. The modular bridge of claim 1, wherein there are two symmetrically-arranged tension members and each tension member applies compression to the longitudinal compression member of the modular bridge.

7. A bridge module for a modular bridge, the modular bridge having a longitudinal direction along the spanning direction, the bridge module being of one-piece construction and forming a segment of the length of the modular bridge;

wherein the one-piece construction includes:

a segment of a first longitudinal compression member of the modular bridge;

a segment of a second longitudinal compression member of the modular bridge;

a segment of a structural lateral element of the modular bridge; and a segment of a shear element of the modular bridge; and the bridge module being arranged to support a portion of a tension member;

such that when multiple bridge modules are assembled they will form the modular bridge having the first longitudinal compression member that is, in use, at an upper part of the modular bridge cross-section;

the second longitudinal compression member that is, in use, at a lower part of the modular bridge cross-section;

the structural lateral element for forming a deck of the modular bridge or for supporting deck elements of the modular bridge; and the shear element for carrying a shear load; and such that the tension member, when tensioned, will apply a compressive force to one of the longitudinal compression members with the tension member forming a main tension element for the modular bridge and the other of the longitudinal compression members forming a main compression element for the modular bridge;

wherein the bridge modules are formed from a composite material and are molded in one piece; and wherein the composite material is a fiber reinforced resin.

8. The bridge module of claim 7, wherein the segments of the first and second longitudinal compression members are formed integrally above and below the segment of the shear element and the segment of the structural lateral element is formed integrally adjacent to the segment of one of the longitudinal compression members.

9. The bridge module of claim 7, wherein there are pairs of first and second longitudinal compression members with a pair of segments of the two second longitudinal compression members formed integrally at either side of the segment of the structural lateral element, a pair of segments of two shear elements formed extending in a direction away from a plane of the segment of the structural lateral element with each shear element formed integrally with one of the pair of segments of the two second longitudinal compression members, and a pair of segments of the two first longitudinal compression members formed integrally with the two shear elements at a location placed away from the plane of the segment of the structural lateral element.

10. The bridge module of claim 7, wherein the molding of the module is designed with areas of increased strength and stiffness to form the segments of the longitudinal compression members.

11. The bridge module of claim 7, wherein the modules have side parts comprising side panels and side-rails, wherein the side panels generally form the segments of the shear elements and the side rails generally form the segments of the upper longitudinal compression members.

12. The bridge module of claim 7, wherein the segments of the shear elements are textured or perforated to provide a visible pattern.

13. The bridge module of claim 7, wherein the bridge module(s) comprise flanges at their longitudinal ends for engaging with corresponding flanges of adjacent bridge module(s).

14. The bridge module of claim 13, wherein the flanges include formations for receiving complementary shaped cores of connectors.

15. A method of assembly for a modular bridge, the method comprising:

providing a plurality of bridge modules, each bridge module being of a one-piece construction and configured to form a segment of a length of the modular bridge;

wherein the one-piece construction includes:

a segment of a first longitudinal compression member of the modular bridge;

a segment of a second longitudinal compression member of the modular bridge;

a segment of a structural lateral element of the modular bridge; and a segment of a shear element of the modular bridge;

aligning the plurality of bridge modules adjacent one another to form the modular bridge having the first longitudinal compression member that is, in use, at an upper part of the modular bridge cross-section, the second longitudinal compression member that is, in use, at a lower part of the modular bridge cross-section, the structural lateral element for forming a deck of the modular bridge or for supporting deck elements of the modular bridge, and the shear element for carrying a shear load;

fitting a tension member to the bridge modules; and tensioning the tension member so as to apply a compressive force to one of the longitudinal compression members with the tension member configured to form a main tension element for the modular bridge and the other of the longitudinal compression members configured to form a main compression element for the modular bridge;

wherein the bridge modules are formed from a composite material and are molded in one piece; and wherein the composite material is a fiber reinforced resin.

16. The method of claim 15, further comprising coupling the bridge modules together with shear joints.

17. The method of claim 15, further comprising assembling the bridge modules together away from an installation location for the modular bridge in one piece or in sections, then maneuvering them to the installation location before fitting and tensioning the tension member.

18. The method of claim 15, further comprising joining the aligned bridge modules to one another; and then later positioning the joined bridge modules in their final position by maneuvering the joined modules by crane or by pulling or pushing the joined modules across the required span.

19. The method of claim 15, further comprising:

joining the aligned bridge modules to one another; and then later positioning the joined bridge modules in a final position by maneuvering the joined modules by crane or by pulling or pushing the joined modules across the required span;

wherein positioning the joined bridge modules comprises:

anchoring a guide tension member at suitable a location near the required bridge location; engaging the joined bridge modules with the guide tension member;

sliding the joined bridge modules along the guide tension member from the other longitudinal side of the final position of the modules into their final position.

20. The method of claim 15 comprising:

joining the aligned bridge modules to one another; and then later positioning the joined bridge modules in a final position by maneuvering the joined modules by crane or by pulling or pushing the joined modules across the required span;

wherein positioning the modular bridge may comprise jacking the joined bridge modules from one longitudinal side of the modular bridge to the other by pushing it out over the required span whilst the modular bridge supports its own weight in cantilevered fashion.

* * * * *